US009470197B2

(12) United States Patent
Moore et al.

(10) Patent No.: US 9,470,197 B2
(45) Date of Patent: Oct. 18, 2016

(54) FUEL INJECTOR HAVING TURBULENCE-REDUCING SAC

(71) Applicant: Caterpillar Inc., Peoria, IL (US)

(72) Inventors: Bryan D. Moore, Washington, IL (US); Sana Mahmood, Fort Collins, CO (US); Daniel R. Ibrahim, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 655 days.

(21) Appl. No.: 13/725,678

(22) Filed: Dec. 21, 2012

(65) Prior Publication Data

US 2014/0175193 A1 Jun. 26, 2014

(51) Int. Cl.

| | |
|---|---|
| ***F02M 61/00*** | (2006.01) |
| ***F02M 59/20*** | (2006.01) |
| ***F02M 61/08*** | (2006.01) |
| ***F02M 47/02*** | (2006.01) |
| ***F02M 61/20*** | (2006.01) |
| ***B05B 1/30*** | (2006.01) |
| ***F02M 61/18*** | (2006.01) |

(52) U.S. Cl.
CPC ..... *F02M 61/1886* (2013.01); *F02M 61/18* (2013.01); *F02M 61/1846* (2013.01)

(58) Field of Classification Search
CPC ..... F02M 61/1886; F02M 61/1846; F02M 61/18; F02M 61/1853; F02M 61/1806
USPC ..... 239/533.2, 533.3, 533.6, 533.7, 533.8, 239/533.9, 584, 585.1–585.5, 533.12
See application file for complete search history.

(56) References Cited

U.S. PATENT DOCUMENTS

| | | | | |
|---|---|---|---|---|
| 4,153,205 | A * | 5/1979 | Parrish, Jr. | 239/533.9 |
| 4,313,407 | A | 2/1982 | Müller | |
| 4,801,095 | A * | 1/1989 | Banzhaf et al. | 239/533.3 |
| 5,383,607 | A | 1/1995 | Heyse et al. | |
| 5,467,924 | A | 11/1995 | Buescher et al. | |
| 6,007,000 | A | 12/1999 | DeLuca | |
| 6,322,007 | B1 | 11/2001 | Potz et al. | |
| 6,491,237 | B1 | 12/2002 | Coppola et al. | |
| 6,564,772 | B1 * | 5/2003 | Shyu et al. | 123/305 |
| 8,083,160 | B2 | 12/2011 | Kato et al. | |
| 8,191,800 | B2 * | 6/2012 | Kitagawa et al. | 239/533.12 |
| 8,794,550 | B2 * | 8/2014 | Kaneko et al. | 239/596 |
| 8,905,333 | B1 * | 12/2014 | Sykes et al. | 239/533.12 |
| 2004/0237929 | A1 * | 12/2004 | Cavanagh et al. | 123/299 |
| 2006/0249600 | A1 * | 11/2006 | Sako et al. | 239/533.12 |
| 2009/0050717 | A1 * | 2/2009 | Takase | 239/533.12 |
| 2010/0258077 | A1 | 10/2010 | Asai et al. | |

(Continued)

FOREIGN PATENT DOCUMENTS

| | | |
|---|---|---|
| DE | 103 55 024 A1 | 6/2005 |
| DE | 10 2008 054 840 A1 | 6/2009 |

(Continued)

*Primary Examiner* — Arthur O Hall
*Assistant Examiner* — Steven M Cernoch
(74) *Attorney, Agent, or Firm* — Finnegan, Henderson, Farabow, Garrett & Dunner, LLP

(57) ABSTRACT

A nozzle for a fuel injector is disclosed. The nozzle may have an internal axial nozzle bore. The nozzle may also have at least one orifice passing from the nozzle bore radially outward through a wall of the nozzle at a tip end. Further, the nozzle may have a sac volume formed in the tip end and defined by a bore radius and a tip radius. The bore radius may be generally perpendicular to the central bore. The tip radius may be generally parallel to the central bore. The tip radius may be less than the bore radius.

17 Claims, 2 Drawing Sheets

(56) References Cited

U.S. PATENT DOCUMENTS

| | | | | |
|---|---|---|---|---|
| 2012/0000996 | A1 | 1/2012 | Kobayashi | |
| 2012/0305678 | A1* | 12/2012 | Kaneko et al. | 239/585.5 |
| 2013/0048758 | A1* | 2/2013 | Omae | 239/533.12 |

FOREIGN PATENT DOCUMENTS

| | | |
|---|---|---|
| JP | 2001099033 | 4/2001 |
| JP | 2009114925 | 5/2009 |
| WO | WO 2004/053326 A1 | 6/2004 |

* cited by examiner

FUEL INJECTOR HAVING TURBULENCE-REDUCING SAC

TECHNICAL FIELD

The present disclosure is directed to a fuel injector and, more particularly, to a fuel injector that has a turbulence-reducing sac.

BACKGROUND

Fuel injectors supply the combustion chamber of an engine with fuel. These injectors flow fuel past a check member and through nozzle orifices. An injector is designed to atomize and disperse fuel as evenly as possible throughout the combustion chamber for a complete and thorough combustion of that fuel. A properly functioning fuel injector flows fuel through its nozzle orifices and sprays a finely atomized mist of fuel into the combustion chamber.

When this fuel flow becomes turbulent, cavitation can occur. Cavitation causes both a reduced effective flow rate, as well as a less even atomization. Diminished atomization can result in incomplete combustion, which increases emissions and lowers fuel efficiency. Turbulent, cavitated flow in the injector's nozzle orifices is detrimental to both fuel injector and engine performance.

One attempt to address this issue is described in U.S. Pat. No. 6,007,000 issued to DeLuca on Dec. 28, 1999. The '000 patent describes a fuel injector nozzle with a hemispherical sac shape, a reduced sac volume, and a center of volume of the sac region that is below a center of radius of the sac bottom. By modifying the sac design in this way, the '000 patent attempts to create a less turbulent flow at the entrances of the nozzle orifices in the sac. The '000 patent claims that this less turbulent flow improves the distribution of fuel throughout the combustion chamber, and results in a more complete combustion of the fuel.

Although the nozzle design of the '000 patent may reduce some of the turbulence in the injector fuel flow, the design may not reduce turbulence enough. The prior art nozzle design's use of a hemispherical sac design creates a sharper transition into the nozzle orifice. This sharper transition may result in undesirable cavitation in the nozzle orifice. Furthermore, the '000 patent may leave a sac volume larger than is necessary.

The present disclosure is directed toward one or more of the problems set forth above.

SUMMARY OF THE INVENTION

In one aspect, the present disclosure is directed to a nozzle for a fuel injector. The nozzle may include an internal axial nozzle bore. The nozzle may also include at least one orifice passing from the nozzle bore radially outward through a wall of the nozzle at a tip end. Further, the nozzle may include a sac volume formed in the tip end and defined by a bore radius and a tip radius. The bore radius may be generally perpendicular to the central bore. The tip radius may be generally parallel to the central bore. The tip radius may be less than the bore radius.

In another aspect, the present disclosure is directed to a nozzle for a fuel injector. The nozzle may include an axial nozzle bore located inside the nozzle. The nozzle may include at least one orifice passing from the nozzle bore radially outward through a wall of the nozzle at a tip end.

Further, the nozzle may include a sac volume formed in the tip end and having a generally elliptical cross-section.

DETAILED DESCRIPTION

Figure 1:
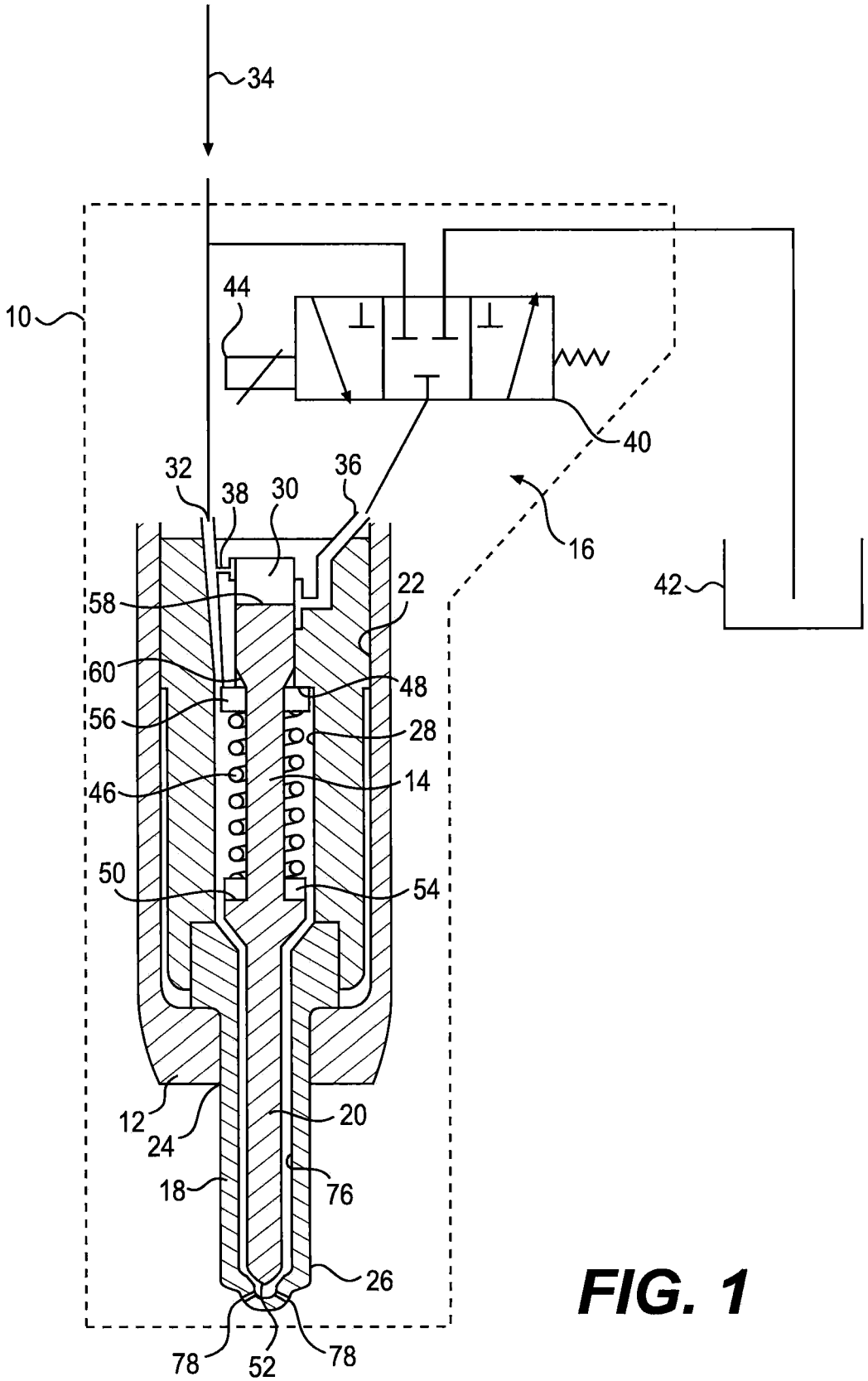
FIG. 1 is a diagrammatic illustration of an exemplary disclosed fuel injector in cross-section.

An exemplary fuel injector 10 is illustrated in FIG. 1. Fuel injector 10 may embody a closed nozzle electronically actuated and controlled fuel injector. For example, fuel injector 10 may include an injector body 12 housing a guide 14, a solenoid actuator 16, a nozzle 18, and a needle valve element 20. It is contemplated that each fuel injector 10 may include additional or different components than those illustrated in FIG. 1, if desired, such as, for example, additional solenoid actuators and additional valve elements. It is further contemplated that fuel injectors 10 may alternatively embody other types of fuel injection devices such as, for example, mechanically actuated electronically controlled injectors, digitally controlled fuel valves, or any other type of fuel injector known in the art.

Injector body 12 may be a cylindrical member configured for assembly within a cylinder head of an engine. Injector body 12 may have a central bore 22 for receiving guide 14 and nozzle 18, and an opening 24 through which a tip end 26 of nozzle 18 may protrude. A sealing member such as, for example, an o-ring (not shown) may be disposed between guide 14 and nozzle 18 to restrict fuel leakage from fuel injector 10.

Guide 14 may also be a cylindrical member having a central bore 28 configured to receive needle valve element 20, and a control chamber 30. Central bore 28 may act as a pressure chamber, holding pressurized fuel that is supplied from a fuel supply passageway 32. During injection, the pressurized fuel from a distribution line 34 may flow through fuel supply passageway 32 and central bore 28 to nozzle 18. It is contemplated that supply passageway 32 may alternatively be routed through and directly flow controlled by solenoid actuator 16, if desired.

Control chamber 30 may be selectively drained of or supplied with pressurized fuel. Specifically, a control passageway 36 may fluidly connect control chamber 30 and solenoid actuator 16 for draining and filling of control chamber 30. Control chamber 30 may also be supplied with pressurized fluid via a supply passageway 38 in communication with fuel supply passageway 32.

Solenoid actuator 16 may be configured to control the flow of fuel into and out of control chamber 30. In particular, solenoid actuator 16 may include a three position proportional valve element 40 disposed within control passageway 36 between control chamber 30 and a tank 42. Proportional valve element 40 may be spring biased and solenoid actuated to move between a first position at which fuel is allowed to flow from control chamber 30 to tank 42, a second position at which pressurized fuel from distribution line 34 flows through control passageway 36 into control chamber 30, and a third position at which fuel flow through control passageway 36 is blocked. The position of proportional valve element 40 between the first, second, and third positions may determine a flow rate of the fuel through control passageway 36, as well as the flow direction. Proportional valve element 40 may be movable to any position between the first, second, and third positions in response to an electric current applied to a solenoid 44 associated with proportional valve element 40. It is contemplated that proportional valve element 40 may alternatively be hydraulically actuated, mechanically actuated, pneumatically actuated, or actuated in any other suitable manner. It is further contemplated that proportional valve element 40 may be a two-position valve element that is movable between only a control chamber draining position and a control chamber filling position or between only a control chamber draining position and a blocked position, if desired.

Figure 2:
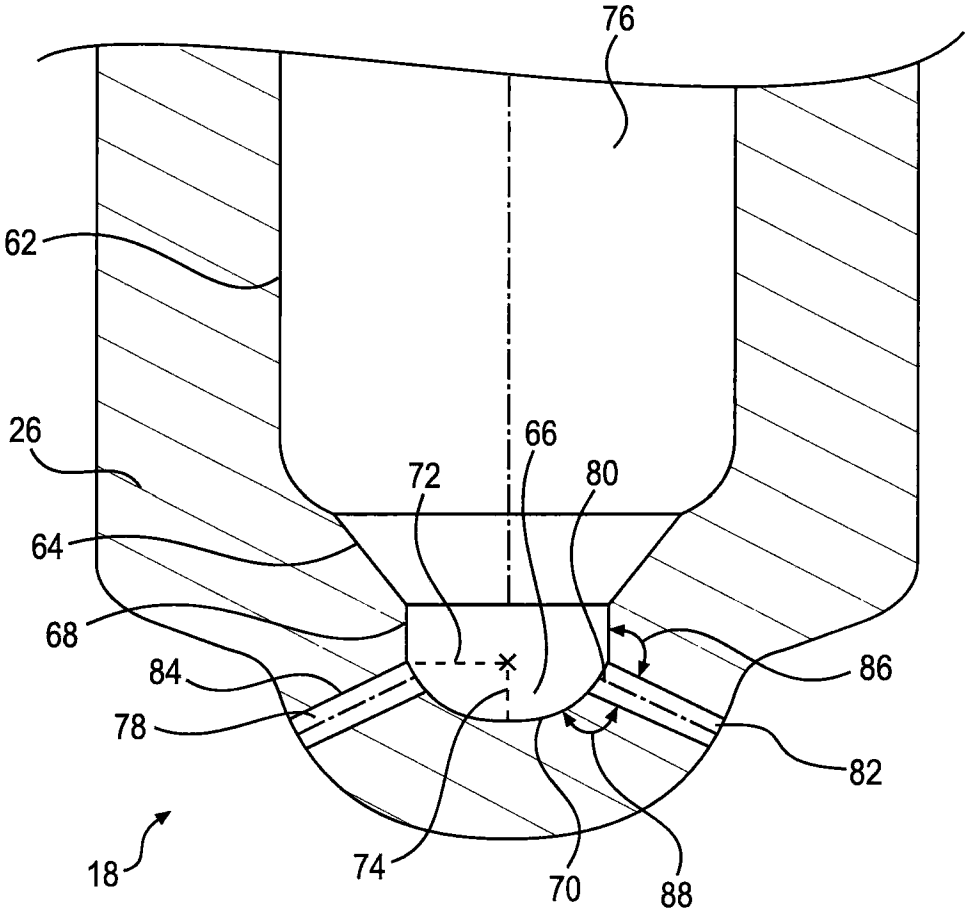
FIG. 2 is a close-up cross-sectional illustration of an exemplary disclosed nozzle for use with the fuel injector of FIG. 1.

Needle valve element 20 may be normally biased toward the first position. In particular, as seen in FIG. 2, each fuel injector 10 may include a spring 46 disposed between a stop 48 of guide 14 and a seating surface 50 of needle valve element 20 to axially bias tip end 52 toward the orifice-blocking position. A first spacer 54 may be disposed between spring 46 and stop 48, and a second spacer 56 may be disposed between spring 46 and seating surface 50 to reduce wear of the components within fuel injector 10.

Needle valve element 20 may have multiple driving hydraulic surfaces. In particular, needle valve element 20 may include a first hydraulic surface 58 tending to drive needle valve element 20 toward the first or orifice-blocking position when acted upon by pressurized fuel within control chamber 30, and a second hydraulic surface 60 that tends to oppose the bias of spring 46 and drive needle valve element 20 in the opposite direction toward the second or orifice-opening position. When biased toward the second position, needle valve element 20 may be configured to substantially restrict or even block the flow of fuel through supply passageway 38.

FIG. 2 illustrates an exemplary embodiment of nozzle 18. Nozzle 18 may include a central nozzle bore 76 passing axially through nozzle 18, and transitioning from a generally cylindrical wall 62 to a generally tapered wall 64 as it approaches a sac volume 66. Sac volume 66 may be bounded by an annular bore wall 68 and an interior sac wall 70. Annular bore wall 68 may be generally parallel to cylindrical wall 62, and may be adjacent to tapered wall 64.

Interior sac wall 70 may be adjacent to annular bore wall 68, and be defined generally by a bore radius 72 and a tip radius 74. Bore radius 72 may be generally perpendicular to nozzle bore 76, and may also be the radius of annular bore wall 68. Tip radius 74 may be generally parallel to nozzle bore 76, and may be the distance from the point of annular bore wall 68 furthest from tapered wall 64 to the central point of interior sac wall 70. Interior sac wall 70 may have a generally elliptical cross section, with bore radius 72 and tip radius 74 being the major and minor axes, respectively. Interior sac wall 70 may have a shape that results from the cross section illustrated in FIG. 2 being rotated about the central axis of nozzle bore 76. Tip radius 74 may be less than bore radius 72, and the ratio of the tip radius 74 to the bore radius 72 may be approximately 2 to 3 or 0.666. In an exemplary embodiment, bore radius 72 may be approximately 0.9 mm, and tip radius 74 may be approximately 0.6 mm.

Sac volume 66 may have at least one orifice 78. Orifice 78 may have an interior end 80 and a exterior end 82. Orifice 78 may also have an annular or tapered orifice wall 84. Orifice 78 may be oriented approximately 65 degrees from the axis of the nozzle bore 76, though other angles may also be used. At interior end 80, the included upstream angle 86 between orifice wall 84 and annular bore wall 68 may be approximately 115 degrees. The included downstream angle 88 between orifice wall 84 and interior sac wall 70 at interior end 80 may be approximately 105 degrees.

In some embodiments, sac volume 66 may have several orifices 78. They may be generally equally spaced radially around the tip end 26. For example, there may be eight orifices 78 spaced around tip end 26 at approximately 45 degree intervals. Alternatively, there may be six orifices 78 spaced around tip end 26 at approximately 60 degree intervals.

INDUSTRIAL APPLICABILITY

The fuel injector of the present disclosure has wide applications in a variety of engine types including, for example, diesel engines, gasoline engines, and gaseous fuel-powered engines. The disclosed fuel injector may be implemented into any engine that utilizes a pressurizing fuel system wherein it may be advantageous to reduce cavitation in a nozzle tip of the fuel injector. The disclosed fuel injector may reduce cavitation in the nozzle tip by reducing the sharpness of fuel flow directional change, which may function to reduce flow separation at that location and, thereby, the likelihood of cavitation. The operation of fuel injector 10 will now be explained.

Needle valve element 20 may be moved by an imbalance of force generated by fluid pressure. For example, when needle valve element 20 is seated against seating surface 50 in the first or orifice-blocking position, pressurized fuel from fuel supply and control passageways 38 and 36 may flow into control chamber 30 to act on first hydraulic surface 58. Simultaneously, pressurized fuel from fuel supply passageway 32 may flow into central bore 28 in anticipation of injection. The force of spring 46 combined with the hydraulic force created at first hydraulic surface 58 may be greater than an opposing force created at second hydraulic surface 60, thereby causing needle valve element 20 to remain in the first position and block fuel flow through orifices 78.

To open orifices 78 to a flow of fuel and initiate the injection of the fuel from central bore 28 into a combustion chamber, solenoid actuator 16 may selectively move proportional valve element 40 to drain pressurized fuel away from control chamber 30 and first hydraulic surface 58. This decrease in pressure acting on first hydraulic surface 58 may allow the opposing force acting across second hydraulic surface 60 to overcome the biasing force of spring 46, thereby moving needle valve element 20 away from seating surface 50.

The shape of sac volume 66 may help reduce the likelihood of cavitation within nozzle 18. By using an elliptical shape, the interior sac wall 70 is flatter at the interior end 80 of orifice 78. This flattening of the slope causes downstream angle 88 to be larger. Because downstream angle 88 may be large, the amount of flow separation near the interior end 80 of orifice 78 may be small. Reducing flow separation near the interior end 80 may improve flow and reduce cavitation through orifice 78. This reduction in the cavitation may result in the injector 10 having a desired flow K-factor. In one exemplary embodiment, the flow K-factor may be approximately 2.2.

Furthermore, the injectors 10 may go through a process of abrasive flow machining that may help to improve flow further by radiusing sharp edges. By increasing the upstream angle 86 and downstream angle 88, the abrasive flow machining process may be more effective at radiusing the edges at interior end 80. This improvement in the abrasive flow machining process may further decrease cavitation and increase the flow through orifice 78.

It will be apparent to those skilled in the art that various modifications and variations can be made to the fuel injector of the present disclosure without departing from the scope of the disclosure. Other embodiments will be apparent to those skilled in the art from consideration of the specification and practice of the fuel injector disclosed herein. It is intended that the specification and examples be considered as exemplary only, with a true scope of the invention being indicated by the following claims and their equivalents.

What is claimed is:

1. A nozzle for a fuel injector, comprising:
an axial nozzle bore located inside the nozzle;
at least one orifice passing radially outward through a wall of the nozzle at a tip end; and
a sac volume formed in the nozzle at the tip end, the sac volume being defined by a bore radius and a tip radius, wherein:
the bore radius is generally perpendicular to the nozzle bore; the tip radius is generally parallel to the nozzle bore;
the tip radius is less than the bore radius; and
a ratio of the tip radius to the bore radius is approximately 0.666.

2. The nozzle of claim 1, wherein the at least one orifice passes through a wall of the nozzle at an angle of approximately 65 degrees from a central axis of the nozzle bore.

3. The nozzle of claim 1, wherein an angle formed between an interior sac wall at a downstream entrance to the at least one orifice and an annular wall of the at least one orifice is approximately 105 degrees.

4. The nozzle of claim 3, wherein an angle formed between an annular wall of the nozzle bore at an upstream entrance to the at least one orifice and an annular wall of the at least one orifice is approximately 115 degrees.

5. The nozzle of claim 1, wherein the nozzle has a K-factor of approximately 2.2.

6. The nozzle of claim 1, wherein the sac volume has a generally elliptical cross-section.

7. The nozzle of claim 1, wherein the bore radius is approximately 0.9 mm, the tip radius is approximately 0.6 mm, and a radius of the at least one orifice is approximately 0.15 mm.

8. The nozzle of claim 1, wherein the at least one orifice includes eight orifices.

9. The nozzle of claim 8, wherein the eight orifices are substantially equally spaced radially around the nozzle at approximately 45 degree intervals.

10. A nozzle for a fuel injector, comprising:
an axial nozzle bore located inside the nozzle;
at least one orifice passing radially outward through a wall of the nozzle at a tip end; and
a sac volume formed in the nozzle at the tip end, the sac volume having a generally elliptical cross-section
wherein a ratio of a minor radius of the elliptical cross-section to a major radius of the elliptical cross-section is approximately 0.666.

11. The nozzle of claim 10, wherein the at least one orifice passes through the nozzle at an angle of approximately 65 degrees from a central axis of the nozzle bore.

12. The nozzle of claim 10, wherein an angle formed between an interior sac wall at a downstream entrance to the at least one orifice and an annular wall of the at least one orifice is approximately 105 degrees.

13. The nozzle of claim 12, wherein an angle formed between an annular wall of the nozzle bore at an upstream entrance to the at least one orifice and an annular wall of the at least one orifice is approximately 115 degrees.

14. The nozzle of claim 10, wherein the at least one orifice includes eight orifices.

15. The nozzle of claim 14, wherein the eight orifices are substantially equally spaced radially around the nozzle at approximately 45 degree intervals.

16. A fuel injector, comprising:
an injector body having a central bore;
a needle valve element having a base end and a tip end, the needle valve element located in the central bore;
a control chamber located at the base end of the needle valve element; and
a nozzle connected to the injector body, the nozzle having:
an axial nozzle bore configured to slidingly receive the needle valve element;
at least one orifice passing radially outward through a wall of the nozzle at
a tip end;
a sac volume formed in the nozzle at the tip end and having a generally elliptical cross-section, the sac volume being defined by a bore radius and a tip radius, wherein:
the bore radius is generally perpendicular to the central bore;
the tip radius is generally parallel to the central bore;
the tip radius is less than the bore radius;
a ratio of the tip radius to the bore radius is approximately 0.666; and
an angle formed between an interior sac wall at a downstream entrance to the at least one orifice and an annular wall of the orifice is approximately 105 degrees.

17. The fuel injector of claim 16, wherein:
an angle formed between an annular wall of the central bore at an upstream entrance to the at least one orifice and an annular wall of the orifice is approximately 115 degrees.

* * * * *